US005449599A

United States Patent [19]

Heremans

[11] Patent Number: 5,449,599

[45] Date of Patent: Sep. 12, 1995

[54] SILVER HALIDE LIGHT-SENSITIVE PHOTOGRAPHIC MATERIAL WITH ENHANCED IMAGE QUALITY FOR RAPID PROCESSING APPLICATIONS IN MAMMOGRAPHY

[75] Inventor: Luc J. Heremans, Leuven, Belgium

[73] Assignee: Agfa-Gevaert, N.V., Mortsel, Belgium

[21] Appl. No.: 183,828

[22] Filed: Jan. 21, 1994

[30] Foreign Application Priority Data

Feb. 12, 1993 [EP] European Pat. Off. ..... 93200383

[51] Int. Cl.[6] ..... G03C 1/005

[52] U.S. Cl. ..... 430/567; 430/605; 430/603; 430/139; 430/502; 430/966; 430/401; 430/963; 430/569

[58] Field of Search ..... 430/567, 605, 603, 139, 430/502, 966, 401, 963, 569

[56] References Cited

U.S. PATENT DOCUMENTS

| | | | |
|---|---|---|---|
| 3,128,184 | 4/1964 | Lowe et al. | 430/605 |
| 3,503,749 | 3/1970 | Hippoliet et al. | 430/605 |
| 5,015,567 | 5/1991 | Suga et al. | 430/567 |
| 5,079,138 | 1/1992 | Takada | 430/567 |
| 5,198,331 | 3/1993 | Takiguchi et al. | 430/605 |
| 5,220,030 | 6/1993 | Deaton | 430/605 |
| 5,230,994 | 7/1993 | Yamada et al. | 430/963 |
| 5,266,442 | 11/1993 | Ooms | 430/603 |
| 5,272,046 | 12/1993 | Sasaoka | 430/963 |

*Primary Examiner*—Thomas R. Neville
*Attorney, Agent, or Firm*—Breiner & Breiner

[57] ABSTRACT

A silver halide light-sensitive photographic material for applications in the field of mammography is disclosed which has an improved diagnostic value by an enhanced sharpness. The silver halide crystals to be used in the said material show a fog level, a toe contrast and an overall contrast that is, like the image quality, substantially uneffected by the processing conditions. The coating amount of silver halide crystals in the emulsion layer can be reduced to such an amount that an archivability of from 10 to 20 years can be assured in normal storage conditions. The X-ray material is suitable for rapid processing, without loss in sensitivity, within processing cycles of 45 or 38 seconds, wherein hardener-free processing solutions can be used.

10 Claims, No Drawings

SILVER HALIDE LIGHT-SENSITIVE PHOTOGRAPHIC MATERIAL WITH ENHANCED IMAGE QUALITY FOR RAPID PROCESSING APPLICATIONS IN MAMMOGRAPHY

DESCRIPTION

1. Field of the Invention

This invention relates to a silver halide photographic light-sensitive material suitable for rapid processing applications in the field of mammography.

2. Background of the Invention

In medical radiography the direct exposure technique is used in mammographic applications, wherein the radiation pattern leaving the patient's breast is registered directly on a film with the use of an intensifying screen.

No other area of medical X-ray applications demands such a level of contrast and spatial resolution as produced in quality mammography. This explains why single-sided films are used in this application.

The success of mammography, whether for screening or diagnosis, depends on the production of high-quality, low-dose images. Image quality determines the accuracy with wich the various structures are recorded and abnormalities detected. For mammography, films high in contrast are preferred. Most of the mammographic films have a high overall-contrast but also the toe contrast, i.e. the contrast in the region of the lightest areas on the film is important. Dense structures in the breast give rise to pale areas on the mammograms. When the degree of contrast is low in this area, i.e. well below the linear portion of the characteristic curve, this area is underexposed. The degree of contrast that can be obtained in this low density area, would be increased, if the film density level is increased within the linear portion of the characteristic curve. This can be achieved by increasing exposure (mAs) or X-ray tube potential (kV). In this way, dense structures in the breast would be less often underexposed, but there are some disadvantages. By increasing the mAs, less dense breast structures may become overexposed, and the most important disadvantageous factor, the dose, is increased. Besides the disadvantage of a decreasing contrast by increasing kV a loss of information may be the resulting effect.

As is generally known for one skilled in the art of photography the sensitometric values and the image quality of a photographic light-sensitive material do not only depend on the characteristics of the emulsion or the composition of the material but are determined also to a considerable extent by the processing conditions. Contrast, speed, and thus also the perceptable detail is affected by processing conditions such as the type of the selected developer, the developer temperature, the degree of development and the condition of the processor. E.g. it is common knowledge that the slope of the characteristic curve of a photographic material increases with increasing degree of development. However once a particular limit has been reached, especially the slope at lower densities decreases with higher degrees of development as the fog caused by development rises. Film processor consistency is vital to the production of high quality mammograms. Variations in image quality can result in possible improper diagnosis and undesirable repetition of making mammograms. Since the current mammographic films are very dependent on the processing conditions, a daily processor quality control is performed in most hospitals, to minimize film processor inconsistency.

On the other hand there is a general trend to enhance the speed of processing, especially in the field of radiography, and therefore interest has been focused on rapid access of radiographs, being vital in diagnosis, with development characteristics as independent as possible from development conditions. Hitherto for mammographic applications there is no film available that can be processed within a total processing cycle of 45 or 38 seconds as is possible for other radiographic applications. Processing in such a short length of time inevitably causes archiving problems due to insufficient fixation and sticking phenomena due to drying problems.

In the patent literature, as e.g. in U.S. Pat. Nos. 3,241,640 and 5,112,731, it has been suggested to make use of tabular silver halide crystals in photographic materials to make them suitable for rapid processing applications. However, in applications for mammography the required gradations cannot be obtained with the said crystals.

Problems concerning fog and too low a contrast at low densities, making definition in that region prohibitive, as well as an intolerable dependance of the sensitometry on processing conditions made an intensive investigation necessary to counter these problems in the field of mammographic applications.

3. Objects of the Invention

Therefore it is an object of this invention to provide a light-sensitive silver halide photographic material for applications in the field of mammography, said material having a very high image quality, i.e. low fog level, high toe contrast and overall-contrast with an enhanced sharpness.

It is another object of this invention to provide a light-sensitive silver halide photographic material showing a characteristic curve, i.e. image quality, that is substantially uneffected by the processing conditions.

It is a further object of this invention to provide a light-sensitive silver halide photographic material suitable for rapid processing within cycles of 45 and 38 seconds, without loss in image quality or sensitivity, and with good archival characteristics.

Other objects will become apparent from the description hereinafter.

4. Summary of the Invention

In accordance with the present invention the above objects are accomplished by providing an X-ray photographic light-sensitive silver halide material comprising a support and one or more hydrophylic colloid layers including at least one light-sensitive silver halide emulsion layer comprising at least one gold and sulphur sensitized monodisperse Cubic silver bromide or silver bromoiodide emulsion with a mean crystal diameter of between 0.1 and 2.0 μm, characterised in that said at least one emulsion has been sensitized with a gold compound in an amount of at least 15 ppm of gold vs. the amount of silver, corresponding to the amount of silver halide coated.

5. Detailed Description

In accordance with this invention it has been found that especially silver bromide and silver bromoiodide emulsions with cubic crystal habit are showing favourable development characteristics with respect to high image quality, without the risk of high fog densities, if the said emulsions are chemically sensitized with high amounts of gold sensitizer.

Even if the said emulsions with cubic crystal habit are in addition showing reduction sensitization due to low pAg values maintained during the precipitation and/or during the chemical ripening stage the sensitivity to fog enhancement is suppressed even though the sensitivity is increased and though it is generally known that the (100)-crystal faces are particularly sensitive to fog.

The parameter determining whether cubic crystals are formed during the precipitation stage of the photographic emulsion making is the pAg of the solution. The pAg of the solution may be regulated by any of the means known in the art of emulsion making, such as the electronic control apparatus and method disclosed in U.S. Pat. No. 3,821,002.

From the article "Der Einflu$\beta$ der Wachstumsbedingungen auf die Kristalltracht der Silberhalogenide" (the influene of Growth Conditions on the Crystalline Behaviour of Silver halides) yon E. Moisar and E. Klein, Bunsengesellschaft für physikalische Chemie, Berichte 67 949–957 (1963) No 9.10., it is known that on allowing tetradecahedral crystals of a homodisperse silver bromide emulsion to grow by controlled addition of solutions of $AgNO_3$ and KBr, crystals of cubic form are obtained under conditions of low excess bromide concentration in the solution phase. With increasing excess of bromide, (111) surfaces are preferentially developed, and ultimately pure octahedral growth is observed.

The pAg-values yielding cubic, resp. octahedral crystals depend on the temperature. In Table I the pAg-neutrality values are set forth for various temperatures, as well as the values for the formation of resp. cubic and octahedral crystals at these temperatures, which are above the pAg-neutrality values. The last column gives the 'change-over pAg values', i.e. the pAg values below which cubic crystals and above which octahedral crystal formation is taking place. Around these pAg values the crystal formation balances between the cubic and the octahedral structure. Values for pAg-neutrality and those preferred for cubic or octahedral crystal formation are summarized in Table I.

TABLE I

| Temp. (°C.) | pAg neutrality | formation pAg for cubic crystals | formation pAg for octahedral crystals | Change-over pAg-value: cubes to octaeders |
|---|---|---|---|---|
| 80° C. | 5.0 | 6.5 | 8.8 | 8.1 |
| 60° C. | 5.4 | 7.0 | 9.4 | 8.7 |
| 40° C. | 5.8 | 7.5 | 10.1 | 9.2 |
| 20° C. | 6.3 | 8.0 | 10.9 | 9.9 |

From the above table it is apparent that the cubic silver halide emulsions as used according to the present invention are precipitated generally under pAg conditions between 6.5 and 8.0.

The silver halide emulsions formed according to the present invention comprise silver bromide or silver bromoiodide. Preferred silver bromoiodide emulsions comprise at most 10 mole % of iodide, more preferably at most 3 mole % and more preferably at most 1 mole %.

A preferred embodiment of making the emulsions used according to the present invention involves the preparation of high-sensitive silver bromide or silver bromoiodide emulsions by precipitation under balanced double jet conditions.

The average grain-size of the silver halide emulsions made according to the present invention is between 0.1 and 2.0 $\mu$m, more preferably between 0.3 and 1.5 $\mu$m, and still more preferably between 0.5 and 0.75 $\mu$m. Grain-growth restrainers or accelerators may be used during the precipation, and the flow rate and concentration of the solutions, the temperature, pAg etc. may be varied to obtain the desired particle size of the silver halide grains. The said particle size can be determined using conventional techniques e.g. as described by Trivelli and M. Smith, The Photographic Journal, vol. 69, 1939, p. 330–338, Loveland "ASTM symposium on light microscopy" 1953, p. 94–122 and Mees and James "The Theory of the photographic process" (1977), Chapter II.

Monodispersed emulsions according to the present invention are prepared depending on the initial conditions during precipitation. Monodispersed emulsions are characterized in the art as emulsions of which at least 95% by weight or number of the grains have a diameter which is within about 40%, preferably within about 30% of the mean grain-diameter and more preferably within about 10% to 20%. A preferred variation coefficient for emulsion grains in accordance with this invention has a value of 0.25, more preferred between 0.15 and 0.20, and still more preferred of 0.10, said variation coefficient being determined as the ratio between the standard deviation of the grain size and the mean crystal size.

Silver halide grains having a narrow grain-size distribution can be obtained by controlling the conditions at which the silver halide grains are prepared using a double jet procedure. In such a procedure, the silver halide grains are prepared by simultaneously running an aqueous solution of a water-soluble silver salt for example, silver nitrate, and water soluble halide, for example, potassium bromide, into a rapidly agitated aqueous solution of a silver halide peptizer, preferably gelatin, a gelatin derivative or some other protein peptizer. Even colloidal silica may be used as a protective colloid as has been described in EP 0392092.

In a preferred embodiment the rates of addition of the silver nitrate and halide salt solutions are steadily increased in such a way that no renucleation appears in the reaction vessel. This procedure is especially recommended, not only to save time but also to avoid physical ripening of the silver halide crystals during precipitation, the so-called Ostwald ripening, which gives rise to the broadening of the silver halide crystal distribution. During the precipitation the volume present in the vessel may be reduced making use of ultrafiltration techniques, which may be further applied to remove the by-products of grain-formation and grain-growth once the grains have reached their ultimate size and shape. Demineralized water, or water with a constant amount of halide salts to wash the ultrafiltrated emulsion to a desired pAg value, may be used, wherein the amounts of water may be added continously or in portions.

In accordance with the present invention, the emulsions are preferably washed by acid-coagulation techniques using acid-coagulable gelatin derivatives or anionic polymeric compounds or, when precipitation occurred in silica medium, by certain polymers capable of forming hydrogen bridges with silica, in an amount sufficient to form coagulable aggregates with the silica particles as has been described in EP Application 517 961.

Coagulation techniques using acid-coagulable gelatin derivatives have been described e.g. in U.S. Pat. Nos. 2,614,928, 2,614,929 and 2,728,662. The acid-coagulable gelatin derivatives are reaction products of gelatin with organic carboxylic or sulphonic acid chlorides, carboxylic acid anhydrides, aromatic isocyanates or 1,4-diketones. The use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acid-coagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the United States Patents referred to above. Particularly suitable are phthaloyl gelatin and N-phenyl carbamoyl gelatin.

It is also possible to wash the emulsion by coagulation techniques using anionic polymeric compounds. Such techniques have been described e.g. in German Patent DE 1,085,422. Particularly suitable anionic polymeric compounds are polystyrene sulphonic acid and sulphonated copolymers of styrene. The anionic polymers can be added to the gelatin solution before precipitation of the silver halide grains or after the stage of emulsification. They are preferably added after the grains have reached their ultimate size and shape, i.e. just before washing. It is also possible to use anionic polymers in combination with acid-coagulable gelatin derivatives as described in the published German Patent Specification No. 2,337,172 (DOS). It is preferred to use low-molecular weight polystyrene sulphonic acid having a molecular weight of at most 30,000. The polystyrene sulphonic acid can be added to the gelatin solution from aqueous solutions preferably comprising from 5 to 20% by weight of polystyrene sulphonic acid. The amounts used suffice to impart coagulation properties to the emulsion and can easily be determined by those skilled in the art.

After the precipitation stage, the silver halide emulsion comprising acid-coagulable gelatin derivative or anionic polymer is acidified e.g. by means of dilute sulphuric acid, citric acid, acetic acid, etc. so as to effect coagulation. Coagulation generally occurs at a pH value comprised between 3 and 4. The coagulum formed may be removed from the liquid by any suitable means, for example the supernatant liquid is decanted or removed by means of a siphon, whereupon the coagulum is washed out once or several times.

Washing of the coagulum may occur by rinsing with mere cold water. However, the first wash water is preferably acidified to lower the pH of the water to the pH of the coagulation point. Anionic polymer e.g. polystyrene sulphonic acid may be added to the wash water even when an acid coagulable gelatin derivative has been used e.g. as described in published German Patent Specification (DOS) 2,337,172 mentioned hereinbefore. Alternatively washing may be effected by redispersing the coagulum in water at elevated temperature using a small amount of alkali, e.g. sodium or ammonium hydroxide, recoagulating by addition of an acid to reduce the pH to the coagulation point and subsequently removing the supernatant liquid. This redispersion and recoagulation operation may be repeated as many times as is necessary.

After the washing operation, the coagulum is redispersed to form a photographic emulsion suitable for the subsequent finishing and coating operations by treating, preferably at a temperature within the range of 35° to 70° C., with the required quantity of water, normal gelatin and, if necessary, alkali for a time sufficient to effect a complete redispersal of the coagulum.

Instead or in addition to normal gelatin, which is preferably used, other known photographic hydrophilic colloids can also be used for redispersion e.g. a gelatin derivative as referred to above, albumin, agar-agar, sodium alginate, hydrolysed cellulose esters, polyvinyl alcohol, hydrophilic polyvinyl copolymers, colloidal silica etc.

In accordance with the present invention the light-sensitive silver bromide or silver bromoiodide emulsions are chemically sensitized with a sulphur and gold sensitizer. This can be done as described i.a. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature sulphur sensitization can be carried out by effecting the ripening in the presence of small amounts of compounds containing sulphur e.g. thiosulphate, thiocyanate, thioureas, sulphites, mercapto compounds, and rhodamines.

Gold sensitization occurs by means of gold compounds, e.g. gold chloride. The addition of thiocyanate ions to the gold ion containing solution is highly preferred so that the gold compound is partially or totally replaced by a gold thiocyanate complex ion that is added as such to the emulsion containing vessel wherein the chemical sensitization is carried out.

It is highly preferred in accordance with this invention to add an amount of gold compound corresponding to at least 15 ppm of gold vs. the amount of silver, corresponding to the amount of silver halide coated. In a preferred embodiment the amount of gold as described hereinbefore is preferably at least 25 ppm, and still more preferably 35 ppm.

Additions of sulphur and gold may be carried out consecutively or simultaneously. In the latter case the addition of goldthiosulphate compounds may be recommended.

In a preferred embodiment in accordance with this invention the weight ratio between added amounts of sulphur and of gold is situated between 0.5 and 5.0 and more preferably between 0.5 and 2.0.

In addition small amounts of compounds of Ir, Rh, Ru, Pb, Cd, Hg, Tl, Pd or Pt may be used. The emulsions may be sensitized in addition by means of reductors e.g. tin compounds as described in GB-A 789,823, amines, hydrazine derivatives, formamidine-sulphinic acids, and silane compounds.

Pretreatment with small amounts of oxidizing agents before adding the already mentioned chemical sensitizers is highly preferred in order to optimize the attainable fog to sensitivity relationship.

In accordance with the present invention compounds for preventing the formation of fog or stabilizing the photographic characteristics during the production or storage of photographic elements or during the photographic treatment thereof may be added. Examples of such stabilizers are heterocyclic nitrogen-containing stabilizing compounds as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide and other disulfide derivatives, and 4-hydroxy-6-methyl-l,3,3a,7-tetraazaindene (TAI) as described by H. Takiguchi in J. Imag. Sci., 32(1),1988, p.20. Besides the addition of 3-pyrazolidinone stabilizing compounds is highly preferred.

The stabilizing agents mentioned hereinbefore are usually added to the coating compositions, especially to the silver halide emulsion containing coating compositions, although the addition of said stabilizing agents to other hydrophilic compositions may not be excluded so as to improve the storage stability of the photographic material, even in severe circumstances of heat and humidity. So the addition of at least one stabilizer, e.g. 4-hydroxy-6-methyl-1,3,3a, 7-tetraazaindene and/or 3-pyrazolidinone and/or phenylmercatotriazole or -tetrazole compounds, to e.g. the hydrophilic protective layer is highly preferred.

Besides in accordance with this invention especially the addition of small amounts of at least one of the selected stabilizers mentioned hereinbefore before, during or at the end of the chemical ripening is desirable.

The chemical ripening may proceed at high temperatures, e.g. 70° C., but preferably proceeds below 50° C.

In order to further improve the storage stability of the photographic material in accordance with this invention the temperature at which the chemical ripening proceeds is lower than 50° C. and still more preferably lower than 47° C., although this measure may deteriorate the sensitivity of the coated material for darkroom light. In this case a compensation may be found by the addition to the silver halide emulsion of the different chemical ripening agents at higher temperatures, e.g. between 55° and 70° C., followed by quickly decreasing the temperature to the preferred value below 50° C.

The cubic silver halide emulsions according to this invention may be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes is given in Research Disclosure Item 22534. Especially preferred green sensitizers in connection with the present invention are anhydro-5,5'-dichloro-3,3'-bis(n.sulfobutyl)-9-ethyloxacarbo-cyanine hydroxide and anhydro-5,5'-dichloro-3,3'-bis(n.sulfopropyl)-9-ethyloxacarbo-cyanine hydroxide.

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, siliconepolyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Especially from the viewpoint of rapid processing conditions development acceleration may be useful, which can be accomplished with the aid of various compounds, preferably polyoxyalkylene derivatives having a molecular weight of at least 400 such as those described in e.g. U.S. Pat. Nos. 3,038,805, 4,038,075, 4,292,400. Especially preferred developing accelerators are recurrent thioether groups containing polyoxyethylenes as described in DE 2 360 878. The same or different or a mixture of different developing accelerators may be added to at least one of the hydrophilic layers at the emulsion side. More preferably at least one development accelerator is added to at least one of the protective layers, preferably to the topcoat layer.

The photographic element of the present invention may further comprise various other additives such as e.g. compounds improving the dimensional stability of the photographic element, UV-absorbers, spacing agents, hardeners, plasticizers, antistatic agents etc. . .

Suitable additives for improving the dimensional stability of the photographic element are i.a. dispersions of a water-soluble or hardly soluble synthetic polymer e.g. polymers of alkyl (meth)acrylates, alkoxy(meth) acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth) acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The photographic material in accordance with this invention is preferably composed of at least one silver halide emulsion layer and at least one hydrophilic layer coated thereover, useful as a protective layer. Besides an afterlayer may be coated as an outermost layer.

The said at least one silver halide emulsion layer may comprise at least one silver halide emulsion comprising silver halide crystals in accordance with the present invention as described hereinbefore. Mixtures of silver halide crystals having the same crystal size but being chemically sensitized differently or mixtures of crystals of a different crystal size may be used in at least one layer. Otherwise, silver halide emulsion crystals of the same size may be added to different silver halide emulsion layers, said silver halide emulsion crystals being chemically ripened with different amounts of ripening agents or silver halide crystals of a different size may be coated into different emulsion layers.

In accordance with this invention the coated amounts of the silver halide emulsion crystals in the emulsion layer(s) described hereinbefore are preferably amounts corresponding to about 4.5 to 8.5 g/m$^2$ of $AgNO_3$. More preferably amounts corresponding to from 5.5 to 7.0 g/m$^2$ of $AgNO_3$ are coated so as to enhance the utility in rapid processing conditions within 45, resp. 38 seconds, especially from the viewpoint of archivability, to be understood as a complete fixation by removal of any excess of unexposed silver halide.

In a preferred embodiment only one silver halide emulsion layer is coated onto the support, having a substrate layer to provide good adhesion characteristics, which emulsion layer is overcoated with a protective antistress layer.

Preferred compounds in the silver halide emulsion layer in accordance with this invention and in the protective layer coated onto the silver halide emulsion layer will be illustrated in the examples following further on.

The photographic element may comprise an antistatic layer e.g. to avoid static discharges during coating, processing and other handlings of the material. Such antistatic layer may be an outermost coating, like the protective layer or an afterlayer, or a stratum of one or more antistatic agents or a coating applied directly to the film support or other support and overcoated with a barrier or gelatin layer. Antistatic compounds suitable for use in such layers are e.g. vanadium pentoxide sols, tin oxide sols or conductive polymers such as polyethylene oxides or a polymer latex and the like.

In accordance with this invention the "gold"-sensitized silver bromide or silver bromoiodide emulsions coated in the emulsion layer(s) as described hereinbefore do reveal a low fog level, a high gradation, especially at low densities, and an excellent developability in different processing conditions, they are particularly suitable for rapid processing applications, especially in processing cycles of 45 and even 38 s. Besides the opportunity is offered to fine-tune the gradation by lowering the coated amount of silver halide crystals and/or enhancing the hardening degree of the hydrophilic binders. The said enhancement of the hardening degree of the coated material provides the possibility to use hardener free processing solutions. This opens the way to one-part package chemistry and concentration regeneration, reducing the volume of chemicals and the amount of packaging material, which is highly requested from the point of view of ecology.

Further lowering the coated amount of silver halide crystals is in favour of archivability due to a higher fixation capacity, whereas an enhanced hardening degree is in favour of a lower water absorption and a higher drying capacity in the processing, avoiding sticking phenomena. Besides the lower amounts of coated silver halide crystals that are causing less scattering from the incident light radiating from the intensifying screen during exposure and the high gradations observed after processing are two important factors in favour of the high definition of the obtained images, enhancing its diagnostic value.

The following examples illustrate the present invention.

6. Examples.

Example 1

A chemically sensitized fast monodisperse negative working silver bromoiodide emulsion having a iodide content of 1 mole % was prepared in the following manner.

50 g of gelatin were added to 1.000 ml of demineralized water containing 15 g of methionin as a growth accelerator under constant stirring at 400 rpm. The mixture was held for 30 minutes at room temperature and heated up to 60° C. This temperature was kept constant during the entire precipitation process.

Before starting the precipitation a few drops of a diluted solution of potassium bromide were added so as to bring the pAg of the solution at a value of 7.9.

36.5 ml of 2.94 N $AgNO_3$ (3.65 % of the total amount of $AgNO_3$) were added under the following conditions. During the first five minutes the flow rate of $AgNO_3$ was kept constant at 7.3 ml/min. A mixture of 99% KBr and 1% KI was added at a variable flow rate so as to keep the pAg constant at 7.9. During the following 68 minutes the flow rate of $AgNO_3$ was steadily increased from 7.3 ml/min up to 21 ml/min whereas the pAg was kept constant at 7.9 by regulating the flow rate of the mixture of KBr and KI, allowing 963 ml of $AgNO_3$ to be added. The latter was realised by means of an automated electronic control apparatus for silver halide preparation disclosed by Claes and Peelaers in Photographische Korrespondenz 102, Band Nr. 10/1967, p. 162.

After five minutes the pH of the emulsion was reduced from 5.8 to 3.5 by adding a sufficient quantity of 6N of sulfuric acid.

Hereupon the conventional treatment processes such as washing and redispersing were applied to the emulsion: pAg was adjusted to a value of 8.4 at 45° C., pH to a value of 5.8. All of the obtained silver halide crystals had a cubic crystal habit and an average diameter of 0.64 μm was measured.

The emulsion was divided into 4 equal quantities. Each part was chemically sensitized for a period of 4 hours at 48° C. in the presence of the same amounts of p-toluene thiosulphonate, sodium thiosulphate, sodium sulphite but each one with a different amount of a mixture of gold(III)-chloride and ammoniumthiocyanate. Differences between those four emulsions are summarized in Table 2. The gold concentration is expressed in ppm with respect to the silver concentration.

The emulsion was spectrally sensitized with anhydro-5,5'-dichloro-3,3'-bis(n.sulfobutyl)-9-ethyloxacarbocyanine hydroxide and stabilized with 4-hydroxy-6-methyl-1,3,3a-tetrazaindene before coating on a polyester support of 175 μm thickness, the emulsion layers coated with silver halide crystals at a ratio of 6.8g/m$^2$ expressed as the equivalent amount of $AgNO_3$.

A series of photographic material samples were made by coating the emulsion on a polyethylene terephthalate support together with a composition for forming a protective gelatin layer. The amount of gelatin per square meter in the emulsion layers was 3.0 g, whereas in the protective layers it was 1.1 g.

Separate strips of the samples were subsequently exposed for the same exposure time to white light through a grey continuous wedge in a Herrnfeld Sensitometer and developed for 12 seconds in a developer having the following composition:

| | |
|---|---|
| hydroquinone | 30 g |
| 1-phenyl-pyrazolidine-3-one | 1.5 g |
| acetic acid 99% | 9.5 ml |
| potassiumsulphite | 63.7 g |
| potassiumchloride | 0.8 g |
| EDTA-2Na | 2.1 g |
| potassium carbonate | 32 g |
| potassiummetabisulfite | 9 g |
| potassium hydroxyde | 14 g |
| diethyleneglycol | 25 ml |
| 6-methylbenztriazol | 0.09 g |
| glutardialdehyd 50% | 9.5 ml |
| 5-nitroindazole | 0.25 g |
| demineralized water to make | 1 l |

The starter solution to be added had the following composition:

| | |
|---|---|
| acetic acid 99% | 15.5 ml |
| KBr | 16 g |
| demineralized water up to | 100 ml |

Hereupon, the developed photographic strips were fixed in a conventional fixing bath comprising e.g. sodium thiosulfate and potassium metabisulfite, and then rinsed in water and allowed to dry.

Sensitometric properties of these film strips are given in Table II. This table shows the sensitometric results in terms of fog, toe contrast and overall contrast of the photographic strips prepared and exposed as set forth above and developed in the developing bath of the composition set forth above during an overall developing time of 12 seconds.

The values given for the toe contrast are the gradation values measured from the sensitometric curve over a density range of 0.90 starting from a density value of 0.10 to 1.00 above fog. For the overall contrast the gradation is measured from the characteristic curve over a density range of 1.75 starting from a density value of 0.25 to 2.00 above fog.

TABLE II

| Emulsion | Au-concentration* | fog | toe contrast | overall contrast | |
|---|---|---|---|---|---|
| 1 | 4 | 33 | 3.43 | 1.89 | comp. |
| 2 | 15 | 13 | 3.56 | 2.06 | invention |
| 3 | 27 | 14 | 3.88 | 2.22 | invention |
| 4 | 35 | 15 | 3.99 | 2.29 | invention |

*Au in ppm, with respect to the amount of silver

Examples No. 2, 3 and 4 clearly illustrate that the presence of gold, in an amount of 15 ppm or more, in the chemical sensitization, results in an increase in toe contrast and overall contrast, accompanied with a lower fog level. For mammographic applications, a toe contrast of at least 2.00 is required.

Example 2

Emulsion No. 5, a comparative emulsion suitable for mammography, was prepared by a conventional single jet method in a vessel, held at 40° C., containing ammonium bromide, potassium bromide, potassium iodide and 42 g of ftaloyl gelatin. The silver nitrate, 20% of which is ammoniacal silver nitrate, is added at a constant rate in 9 minutes unter constant stirring at a rate of 400 rpm. After a physical ripening time of 11 minutes, an additional amount of 21 g of gelatin was added. The obtained emulsion was an octaedric silver bromoiodide emulsion with 2% mole percent of iodide and with an average grain diameter of 0.50 μm.

After addition of sulphuric acid to a pH value of 3.5 stirring was stopped and after sedimentation the supernatant liquid was removed. The washing procedure was started after a scrape-rudder was installed and after addition of polystyrene sulphonic acid in the first turn to get a quantitative flocculate without silver losses. During redispersion of the emulsion 150 g of gelatine was added. The emulsion was chemically sensitized with sulphur and gold at 47° C. for 5 hours and was stabilized with 4-hydroxy-6-methyl-1,3,3a-tetrazaindene before coating on a polyester support of 175 μm thickness, the emulsion layers coated at a ratio of 6.8g/m$^2$expressed as the equivalent amount of $AgNO_3$.

The emulsions No. 6 and 7 correspond to the respective emulsions 1 and 4 of table II.

Separate strips of the samples coated as described hereinbefore were subsequently exposed to white light through a grey continuous wedge in a Hernfeld Sensitometer.

The three different materials, coated with emulsion Nos. 5, 6, and 7 respectively, were processed in different types of developer, at different temperatures. The said different developer types had the following composition:

dev.1: developer composition as descriped in example 1 dev.2: a developer with the following composition:

| | |
|---|---|
| potassiumhydroxide | 29.6 g |

-continued

| | |
|---|---|
| potassiumsulphite | 15 g |
| boric acid | 18.7 g |
| sodium sulphite | 25 g |
| EDTA-2Na | 1.5 g |
| hydroquinone | 20 g |
| 1-phenyl-5-mercaptotetrazole | 20 mg |
| sodium bromide | 2 g |
| acetic acid | 8.8 ml |
| 1-phenyl-pyrazolidine-3-one | 0.9 g |
| 6-nitrobenzimidazole | 90 mg |
| polyglycol 200 | 0.25 ml |
| glutardialdehyde 50% | 7.5 ml |
| potassiummetabisulphite | 10 g |
| demineralized water to make | 1 l |

Starter solution to be added:

| | |
|---|---|
| sodiumbromide | 36 g |
| acetic acid 99% | 20 ml |
| demineralized water up to | 100 ml |

dev.3: Adefo Mix S, trade name product of Adefo
dev.4: a developer with the following composition:

| | |
|---|---|
| EDTA-2Na | 1.6 g |
| potassiumhydroxide | 33.6 g |
| sodiummetabisulphite | 30 g |
| hydroquinone | 16 g |
| 6-methylbenztriazol | 48 mg |
| sodiumtetraborate.10 aq | 10.6 g |
| acetic acid 99% | 6.2 ml |
| 1-phenyl-pyrazolidine-3-one | 0.9 g |
| 6-nitrobenzimidazole | 60 mg |
| glutardialdehyd 50% | 6.4 ml |
| potassiummetabisulphite | 4.6 g |

Starter solution to be added:

| | |
|---|---|
| acetic acid 99% | 16 ml |
| potassiumbromide | 16 g |
| potassiumiodide | 40 mg |
| demineralized water up to | 100 ml |

dev.5: Russel AUTO-MAT 2000, trade name product of L. B. Russel Chemicals de Mexico Emulsion Nos. 5,6 and 7 were processed in 16 different processing conditions. Except for processing condition 1 (where the processor was a EK M6/5 automatic processor) the processing was performed in a EK M6/3 automatic processor, both processors being trade name products marketed by Eastman Kodak.

In Table III the base+fog density (B+F) and the speed values (absolute values corresponding to a density of 1 above fog, expressed in log Ixt) are summarized for all different processing conditions in the different developers described hereinbefore and at different temperatures, given in column 2 of Table III. In the last row but one, the calculated standard deviation is given. In the lowest row the total range of all the values for one emulsion is shown.

TABLE III

| dev. type | T (°C.) | B + F emul. 5 comp. | B + F emul. 6 comp. | B + F emul. 7 inven. | Speed emul. 5 comp. | Speed emul. 6 comp. | Speed emul. 7 inven. |
|---|---|---|---|---|---|---|---|
| 1 | 33 | 189 | 219 | 199 | 174 | 168 | 167 |
| 2 | 34 | 182 | 194 | 186 | 189 | 184 | 180 |
| 2 | 37 | 185 | 201 | 190 | 177 | 177 | 175 |

TABLE III-continued

| dev. type | T (°C.) | B + F emul. 5 comp. | B + F emul. 6 comp. | B + F emul. 7 inven. | Speed emul. 5 comp. | Speed emul. 6 comp. | Speed emul. 7 inven. |
|---|---|---|---|---|---|---|---|
| 2 | 40 | 188 | 207 | 192 | 167 | 170 | 171 |
| 3 | 34 | 182 | 203 | 191 | 186 | 177 | 176 |
| 3 | 37 | 187 | 210 | 194 | 174 | 170 | 170 |
| 3 | 40 | 196 | 228 | 203 | 162 | 163 | 166 |
| 4 | 34 | 183 | 196 | 185 | 192 | 182 | 179 |
| 4 | 37 | 184 | 202 | 188 | 184 | 176 | 175 |
| 4 | 40 | 190 | 215 | 192 | 176 | 170 | 171 |
| 1 | 34 | 185 | 200 | 187 | 182 | 175 | 174 |
| 1 | 37 | 188 | 190 | 208 | 174 | 169 | 171 |
| 1 | 40 | 194 | 221 | 195 | 167 | 163 | 168 |
| 5 | 34 | 192 | 228 | 198 | 182 | 172 | 174 |
| 5 | 37 | 201 | 245 | 208 | 176 | 168 | 171 |
| 5 | 40 | 221 | 274 | 223 | 170 | 164 | 169 |
| * | | 9 | 20 | 9 | 8 | 6 | 4 |
| ** | | 39 | 80 | 38 | 30 | 21 | 14 |

*standard deviation
**range

The results for the toe contrast and for the overall contrast (as defined in example 1) in the 16 different processing condition are summarized in table IV.

TABLE IV

| dev. type | T (°C.) | Toe contr. emul. 5 comp. | Toe contr. emul. 6 comp. | Toe contr. emul. 7 inven. | Over. contr. emul. 5 comp. | Over. contr. emul. 6 comp. | Over. contr. emul. 7 inven. |
|---|---|---|---|---|---|---|---|
| 1 | 33 | 200 | 197 | 220 | 359 | 369 | 364 |
| 2 | 34 | 202 | 204 | 232 | 327 | 349 | 356 |
| 2 | 37 | 219 | 204 | 228 | 357 | 356 | 357 |
| 2 | 40 | 237 | 203 | 229 | 388 | 360 | 358 |
| 3 | 34 | 192 | 191 | 217 | 325 | 346 | 358 |
| 3 | 37 | 203 | 196 | 218 | 351 | 365 | 375 |
| 3 | 40 | 218 | 196 | 217 | 370 | 362 | 370 |
| 4 | 34 | 173 | 194 | 226 | 266 | 356 | 360 |
| 4 | 37 | 178 | 188 | 216 | 289 | 353 | 350 |
| 4 | 40 | 171 | 184 | 208 | 303 | 356 | 351 |
| 1 | 34 | 197 | 197 | 224 | 360 | 378 | 375 |
| 1 | 37 | 203 | 195 | 224 | 374 | 380 | 375 |
| 1 | 40 | 206 | 192 | 221 | 391 | 374 | 374 |
| 5 | 34 | 175 | 178 | 209 | 306 | 329 | 339 |
| 5 | 37 | 176 | 180 | 209 | 309 | 333 | 342 |
| 5 | 40 | 176 | 181 | 211 | 320 | 333 | 341 |
| * | | 19 | 8 | 7 | 36 | 15 | 12 |
| ** | | 66 | 26 | 24 | 125 | 51 | 36 |

*standard deviation
**range

From Tables III and IV is clear that for emulsion 7, prepared according to this invention, the range for the sensitometric data such as speed, toe contrast and overall contrast is much lower than for the comparative emulsions Nos. 5 and 6. Especially the sensitometric behaviour of emulsion No. 5, bearing octahedral silver bromoiodide crystals, is strongly influenced upon the processing conditions. Also emulsion No. 6, characterized by the presence of cubic crystal, chemically sensitized with less then 15 ppm Au, is more effected by the processing conditions than emulsion No. 7, according to the invention. The differences are especially reflected by the differences in the base +fog density and speed values.

Example 3

Emulsions 8 and 9 correspond to the respective emulsions 1 and 4 of Table II.

Emulsion 10 is the same as 9, except that it was coated at a ratio of 5.5 g/m$^2$ expressed as the equivalent amount of $AgNO_3$.

Emulsions 11,12 and 13 are the same as Emulsion 10, except for the ratio hardening agent to gelatine. The different ratios are summarised in Table V.

Separate strips of these 6 samples (Emulsions 8-13) were subsequently exposed for the same exposure time to white light through a grey continuous wedge in a Hernnfeld sensitometer, and processed in a Curix HT 530, trade name product of Agfa-Gevaert, in processing cycles of 90, 45 and 38 seconds, with as developer a one-part package developer without hardening agent, and as fixer a one-part package fixer without hardening agent. The processing cycle is defined as the period of time from the input of an exposed film in the processor to the moment the film appears at the dryer exit.

Composition of the developer: -concentrated part:

| | |
|---|---|
| water | 200 ml |
| potassium bromide | 6 g |
| potassium sulphite (65% solution) | 247 g |
| ethylenediaminetetraacetic acid, sodium salt, trihydrate | 9.6 g |
| hydroquinone | 112 g |
| 5-methylbenzotriazole | 0.076 g |
| 1-phenyl-5-mercaptotetrazole | 0.040 g |
| sodiumtetraborate (decahydrate) | 18 g |
| potassium carbonate | 38 g |
| potassium hydroxyde | 42 g |
| diethylene glycol | 100 g |
| potassium iodide | 0.088 g |
| 4-hydroxymethyl-4methyl-1phenyl-3-pyrazolidinone | 12 g |
| Water to make | 1 liter |

For initiation of the processing one part of the concentrated developer was mixed with 3 parts of water. No starter was added. The pH of this mixture was 10.40 at 25° The toe contrast and overall-contrast (as defined in example 1) and the archivability for the different samples all summarized in Table V. The archivability test was done as following: a sheet of unexposed film of each sample was processed in all the different processing cycles. A drop of a residual hypo test solution is placed on the film. This residual hypo test solution is composed of 10 grams of silver nitrate and of 30 ml of acetic acid (99%) and sufficient distilled water to make 1 liter of solution. After the drop was placed on the unexposed film, the solution stand for two minutes on the film, after those two minutes the excessive solution amount was blot off. The density difference, between the density on the spot where the solution was placed and the density on the strip next to the spot, was measured with a Macbeth TD903 densitometer. This density difference is a measure for the amount of residual hypo in the film. The said density difference,multiplied with 11, is a measure for the amount of ammoniumthiosulphate (in mg/m$^2$) restained in the film. To ensure a good archivability, this value should not exceed 175.

TABLE V

| Em. No. | $AgNO_3$ in g/m$^2$ | Formal-dehyde* | proc. cycle (sec) | Toe contrast | Overall contrast | Archiv-ability |
|---|---|---|---|---|---|---|
| 8 | 6.8 | 21 | 90 | 179 | 322 | 44 |
| 9 | 6.8 | 25 | 90 | 214 | 358 | 33 |
| 10 | 5.5 | 29 | 90 | 203 | 318 | 33 |
| 11 | 5.5 | 24.6 | 90 | 210 | 329 | 33 |
| 12 | 5.5 | 20.3 | 90 | 213 | 331 | 33 |
| 13 | 5.5 | 14.5 | 90 | 224 | 343 | 33 |
| 8 | 6.8 | 21 | 45 | 181 | 308 | 154 |
| 9 | 6.8 | 25 | 45 | 213 | 356 | 247 |
| 10 | 5.5 | 29 | 45 | 205 | 330 | 55 |
| 11 | 5.5 | 24.6 | 45 | 207 | 332 | 33 |
| 12 | 5.5 | 20.3 | 45 | 205 | 335 | 44 |
| 13 | 5.5 | 14.5 | 45 | 220 | 357 | 44 |
| 8 | 6.8 | 21 | 38 | 147 | 294 | 501 |
| 9 | 6.8 | 25 | 38 | 228 | 369 | 451 |
| 10 | 5.5 | 29 | 38 | 202 | 323 | 50 |
| 11 | 5.5 | 24.6 | 38 | 206 | 333 | 60 |
| 12 | 5.5 | 20.3 | 38 | 206 | 338 | 55 |
| 13 | 5.5 | 14.5 | 38 | 216 | 354 | 70 |

*expressed as mg formaldehyde/gram of gelatin

As it is clear from Table V, a material with an emulsion according the invention (emulsions 9 to 13) is suitable for mammographic applications, even in short processing cycles of 45 and 38 seconds, with one-package hardener-free developer and fixer. With the invention, an adequate toe contrast and average contrast is reached, even in the short developing cycle. With 6.8 g $AgNO_3$/m$^2$ the archivability is above the limit. Decreasing the amount of silver/m$^2$ wich is possible with this invention because of the high toe contrast and overall contrast, results in a sufficient archivability of from 10 to 20 years normal storage conditions, i.e. moderate values of temperatures and relative humidities.

I claim:

1. An X-ray photographic light-sensitive silver halide material comprising a support and one or more hydrophilic colloid layers and a total amount of silver halide, expressed as the equivalent amount of silver nitrate, between 4.5 and 8.5 g/m$^2$ and, at least one light-sensitive silver halide emulsion layer comprising at least one gold and sulphur sensitized monodisperse cubic silver bromide or silver bromoiodide emulsion with a mean crystal diameter of between 0.1 and 2.0 μm, and a iodide content of from 0 to at most 3 mole %, characterized in that said at least one emulsion has been sensitized with a gold compound in an amount of at least 15 ppm of gold vs. the amount of silver, corresponding to the amount of silver halide coated.

2. An X-ray photographic light-sensitive silver halide material according to claim 1, wherein said at least one emulsion has been sensitized with a gold compound in an amount of at least 25 ppm of gold vs. the amount of silver, corresponding to the amount of silver halide coated.

3. An X-ray photographic light-sensitive silver halide material according to claim 1, wherein said at least one emulsion has been sensitized with a gold compound in an amount of at least 35 ppm of gold vs. the amount of silver, corresponding to the amount of silver halide coated.

4. An X-ray photographic light-sensitive silver halide material according to claim 1, wherein the mean crystal diameter of the cubic crystals is between 0.1 and 1.5 μm.

5. An X-ray photographic light-sensitive silver halide material according to claim 1, wherein the mean crystal diameter of the cubic crystals is between 0.1 and 1.0 μm.

6. Method of processing an X-ray photographic light-sensitive silver halide material according to claim 1 within a total dry-to-dry processing cycle of less than 50 seconds by the steps of developing, rinsing, fixing, rinsing and drying the said material.

7. Method of processing an X-ray photographic light-sensitive silver halide material according to claim 1 within a total dry-to-dry processing cycle of less than 50 seconds by the steps of developing, rinsing, fixing, rinsing and drying the said material and wherein developing and/or fixing proceeds in hardener-free developing and fixing solutions.

8. An X-ray photographic light-sensitive silver halide material according to claim 1, wherein the total amount of silver halide coated, expressed as the equivalent amount of silver nitrate, is between 5.5 and 7.0 $g/m^2$.

9. An X-ray photographic light-sensitive silver halide material according to claim 1, wherein said monodisperse cubic silver bromoiodide emulsion has iodide ions divided homogeneously over the crystal volume of the emulsion crystals.

10. An X-ray photographic light-sensitive silver halide material according to claim 1, wherein the said iodide content is from 0 to 1 mole %.

* * * * *